US007103997B2

(12) United States Patent
Ruffino

(10) Patent No.: US 7,103,997 B2
(45) **Date of Patent: *Sep. 12, 2006**

(54) LOTTERY CARD READER

(76) Inventor: Peter J. Ruffino, 273 Wellington Rd., Buffalo, NY (US) 14216

( * ) Notice: Subject to any disclaimer, the term of this patent is extended or adjusted under 35 U.S.C. 154(b) by 4 days.

This patent is subject to a terminal disclaimer.

(21) Appl. No.: 10/605,629

(22) Filed: Oct. 15, 2003

(65) Prior Publication Data

US 2004/0123505 A1 Jul. 1, 2004

Related U.S. Application Data

(63) Continuation-in-part of application No. 09/745,524, filed on Dec. 23, 2000, now Pat. No. 6,634,126.

(51) Int. Cl.
*G09F 3/16* (2006.01)

(52) U.S. Cl. ..... 40/658; 40/661

(58) Field of Classification Search ..... 40/658, 40/661, 666; 273/148 R; 24/67 R, 67.3, 24/67.5, 67.7; 434/408

See application file for complete search history.

(56) References Cited

U.S. PATENT DOCUMENTS

| | | | | | |
|---|---|---|---|---|---|
| D303,401 | S * | 9/1989 | Cross et al. | ..... | D19/88 |
| 5,301,393 | A * | 4/1994 | Brown | ..... | 24/67.7 |
| 5,308,034 | A * | 5/1994 | Hunter | ..... | 248/452 |
| 5,647,156 | A * | 7/1997 | Hull et al. | ..... | 40/661 |
| 6,634,126 | B1 * | 10/2003 | Ruffino | ..... | 40/658 |

* cited by examiner

*Primary Examiner*—Brian K. Green
(74) *Attorney, Agent, or Firm*—Richard D. Fuerle

(57) ABSTRACT

A lottery card reader has a clip made from two separate pieces that are assembled together and a transparent flap attached to the clip. The clip has a first and a second pair of arms attached to a pivot. The arms in the first pair are separated and the arms in the second pair are resiliently biased towards each other. Moving the first pair of arms together moves the second pair of arms apart. The transparent flap can cover games on a lottery card to which the clip is attached. When a lottery card is inserted between the second pair of arms under the transparent flap it is releaseably gripped by the second pair of arms.

20 Claims, 10 Drawing Sheets

LOTTERY CARD READER

CROSS REFERENCE TO RELATED APPLICATIONS

This application is a continuation-in-part of application Ser. No. 09/745,524, filed Dec. 23, 2000, now U.S. Pat. No. 6,634,126.

BACKGROUND OF INVENTION

This invention relates to a lottery card reader that can be used to easily check a lottery card to determine if the numbers chosen were winning numbers. In particular, it relates to a lottery card reader that can be moved along a lottery card and can grip it at any position, and that has a transparent flap on which the winning numbers can be marked.

Numerous states in the United States operate lotteries as a way of raising money. Many of these lotteries use a card printed with groups of numbers, each group constituting a separate game of chance. A person may purchase any or all of the games on a card. He plays the games by marking his choice of numbers in each game he bought. A machine then reads the card and returns it to the player.

When the winning numbers are announced, the purchaser must compare the winning numbers to the numbers he chose on his card. If he purchased only one game, the comparison is easily accomplished. But if several games were played, the comparison must be made for each game, and that can be tedious, time-consuming, and prone to error.

Various types of lottery card readers have been invented to help a person determine his winning numbers. Some of these readers must be punched out in the proper position for each winning number, which may lead to errors if the hole is not made in precisely the correct position. Others are suitable for reading the cards of only one type of game, or the cards from only one state, and cannot be used for cards of other states or other types of games.

SUMMARY OF INVENTION

I have invented a lottery card reader that is simple, inexpensive, and can be used to accurately read almost any lottery card. Using the lottery card reader of this invention requires only marking the winning numbers on the reader and sliding it across the lottery card to the position of each game.

In a preferred embodiment, a clip is made from two separate pieces that assemble together, which simplifies manufacturing and lowers cost.

DETAILED DESCRIPTION

Figure 1:
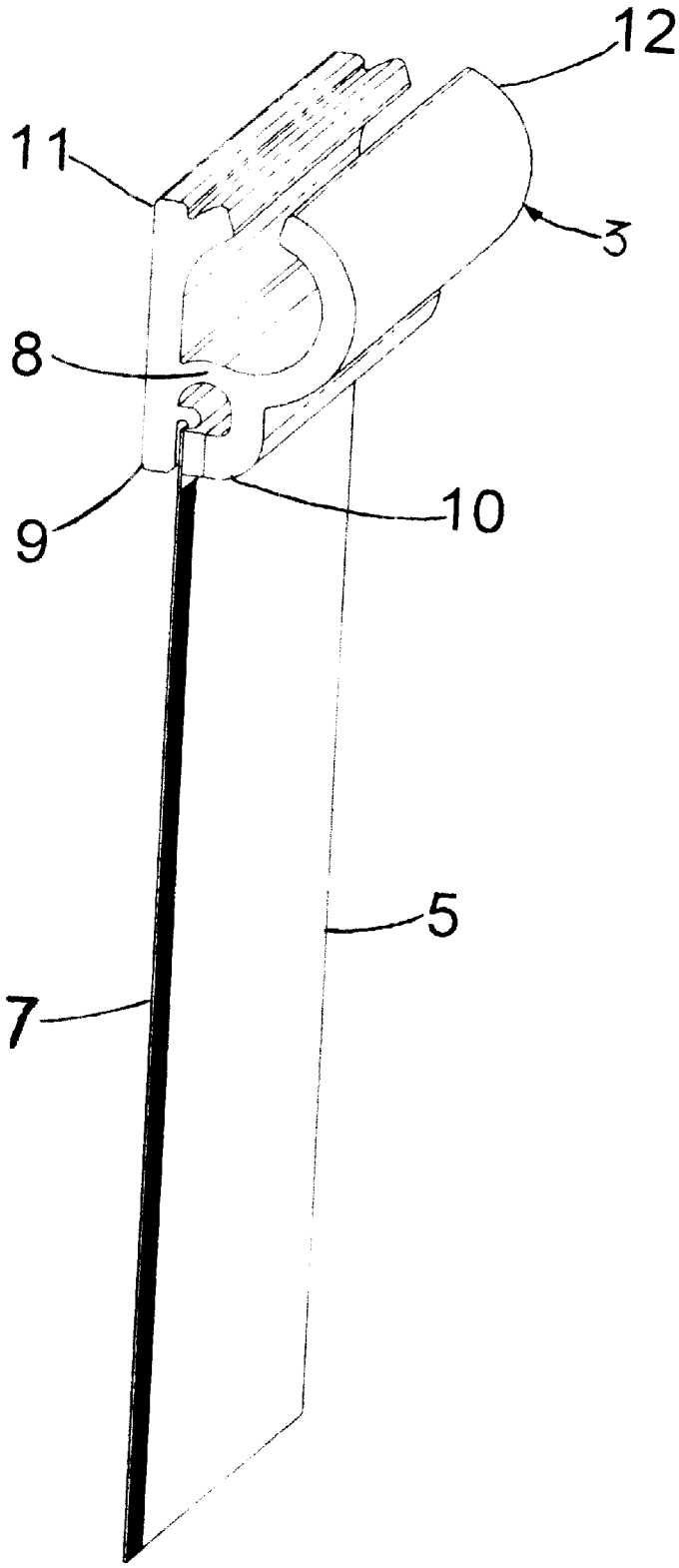
FIG. 1 is an isometric view of a certain presently preferred embodiment of a lottery card reader according to this invention.
Figure 2:
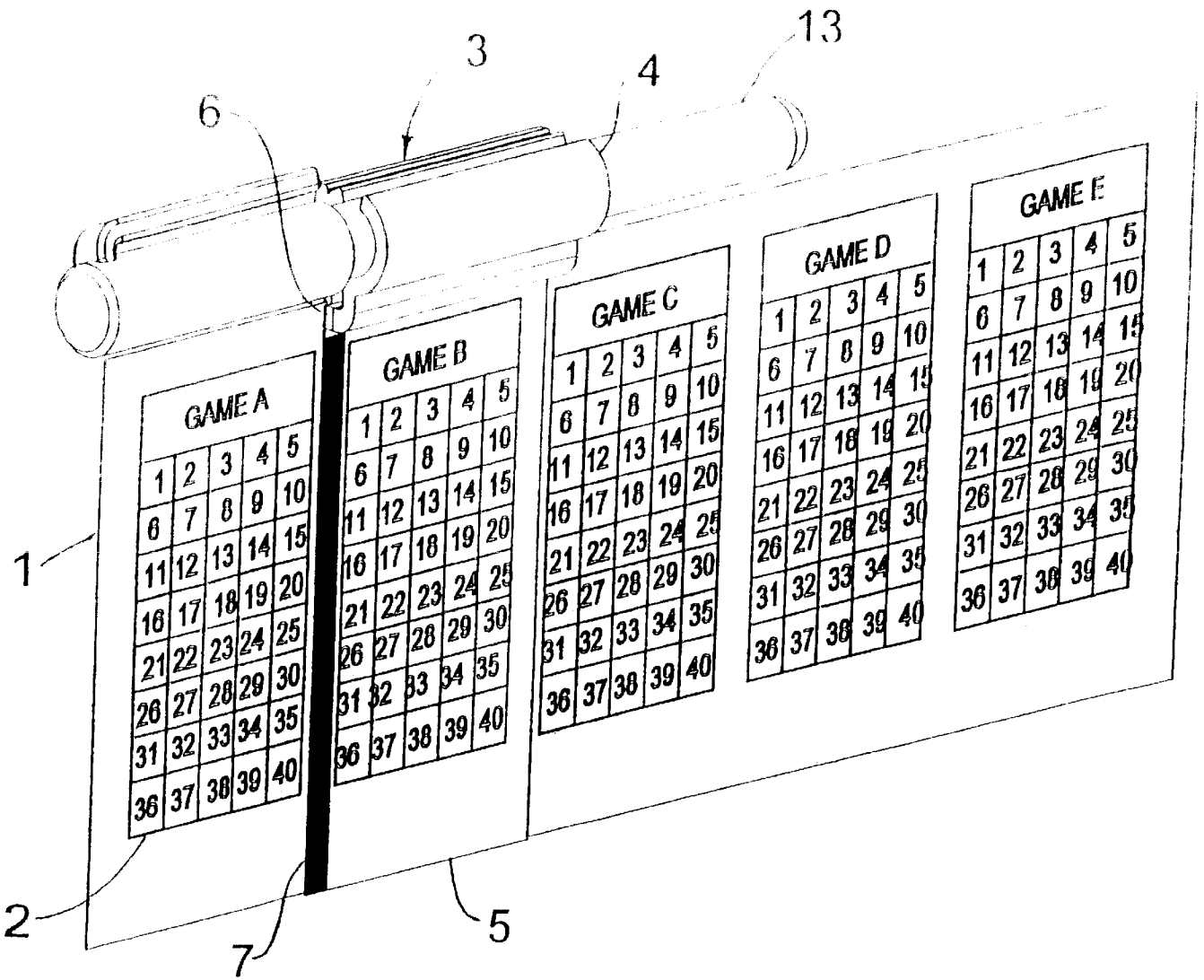
FIG. 2 is an isometric view of the lottery card reader of FIG. 1 clipped to a lottery card.

Referring to FIG. 2, lottery card 1 is printed with five arrays 2 of 40 numbers each, arranged in 8 rows and 5 columns, each array 2 being for a separate lottery game. Over lottery card 1 has been placed lottery card reader 3. Referring to FIGS. 1 and 2, lottery card reader 3 has a clip 4 and a transparent flap 5 attached to clip 4 by adhesive 6. Flap 5 can also be attached to clip 4 by other means, such as rivets or using heat and pressure to bond it to clip 4. Transparent flap 5 is rectangular and large enough to cover any one of the arrays 2 on lottery card 1. Flap 5 is a single, unfolded sheet, preferable about 3 to about 4 inches long and about 1¾ to about 2 inches wide and can be eraseably written on in ink. Vertical reference line 7 printed on flap 5 enables the user to align flap 5 with any array 2 on lottery card 1.

Clip 4 has a flexible, resilient bridge 8, from which extend rigid four arms 9, 10, 11, and 12. Arms 9 and 10 make contact when lottery card 1 is not between them and grip lottery card 1 when it is between them. Arms 11 and 12 do not make contact and are shaped to hold a writing instrument 13, such as a pen or marker, that can mark transparent flap 5. Bridge 8 functions as a fulcrum so that squeezing arms 11 and 12 together separates arms 9 and 10, releasing lottery card 1. Clip 4 is preferably made of molded or extruded plastic, though it could also be made of metal or other materials. Clip 4 can also be releaseably attached to lottery card 1 by other means, such as a screw or easily releaseable adhesive. Clip 4 may be described as having (1) a first molded piece of plastic having a clasping arm, a gripping arm and a fulcrum therebetween; (2) a second molded piece of plastic having a clasping arm, a gripping arm, a fulcrum therebetween that engages the fulcrum of the first molded piece of plastic, and having a resilient member that extends from the second molded piece of plastic and contacts the first molded piece of plastic; (3) molded plastic means extending from one of the molded pieces of plastic for attaching the first molded piece of plastic to the second molded piece of plastic so that the clasping arm of the first molded piece of plastic opposes the clasping arm of the second molded piece of plastic and the gripping arm of the first molded piece of plastic opposes the gripping arm of the second molded piece of plastic, and the resilient member resiliently forces the clasping arms together and the gripping arms apart.

To use lottery card reader 3, writing instrument 13 is removed and arms 11 and 12 are squeezed together, which separates arms 9 and 10. Lottery card reader 3 is then placed over the top of a lottery card 1 so that reference line 7 is aligned with the numbers of at least one game, which can be seen through transparent flap 5. The numbers chosen for two or more lottery games played have already been marked on lottery card 1. For example, if six numbers out of 40 are picked for each game and 2 games have been purchased, one array of numbers might have numbers 5, 9, 19, 27, 29, and 34 marked and another array of numbers might have numbers 3, 7, 18, 21, 38, and 39 marked. If the winning numbers are 9, 18, 28, 34, 36, and 39, those numbers are circled or otherwise marked on transparent flap 5. Arms 11 and 12 are squeezed together, separating arms 9 and 10, and lottery card reader 3 is moved across lottery card 1 until the numbers marked on transparent flap 5 coincide with the same symbols on lottery card 1. Arms 11 and 12 are then released, causing bridge 8 to move arms 9 and 10 together, attaching lottery card reader 3 to lottery card 1. If a number is marked on both lottery card 1 and on transparent flap 5 it indicates that a winning number was chosen in that game. For example, numbers 9 and 34 would be marked on both lottery card 1 and flap 5 for the first game and numbers 18 and 39 would be marked on both lottery card 1 and flap 5 for the second game. Clip 4 can also be attached to the side of a lottery ticket (similar to a lottery card, but issued by a machine, which chooses the numbers played) so that the player can write the winning numbers on the transparent flap and align them with the numbers on the ticket.

Figure 3:
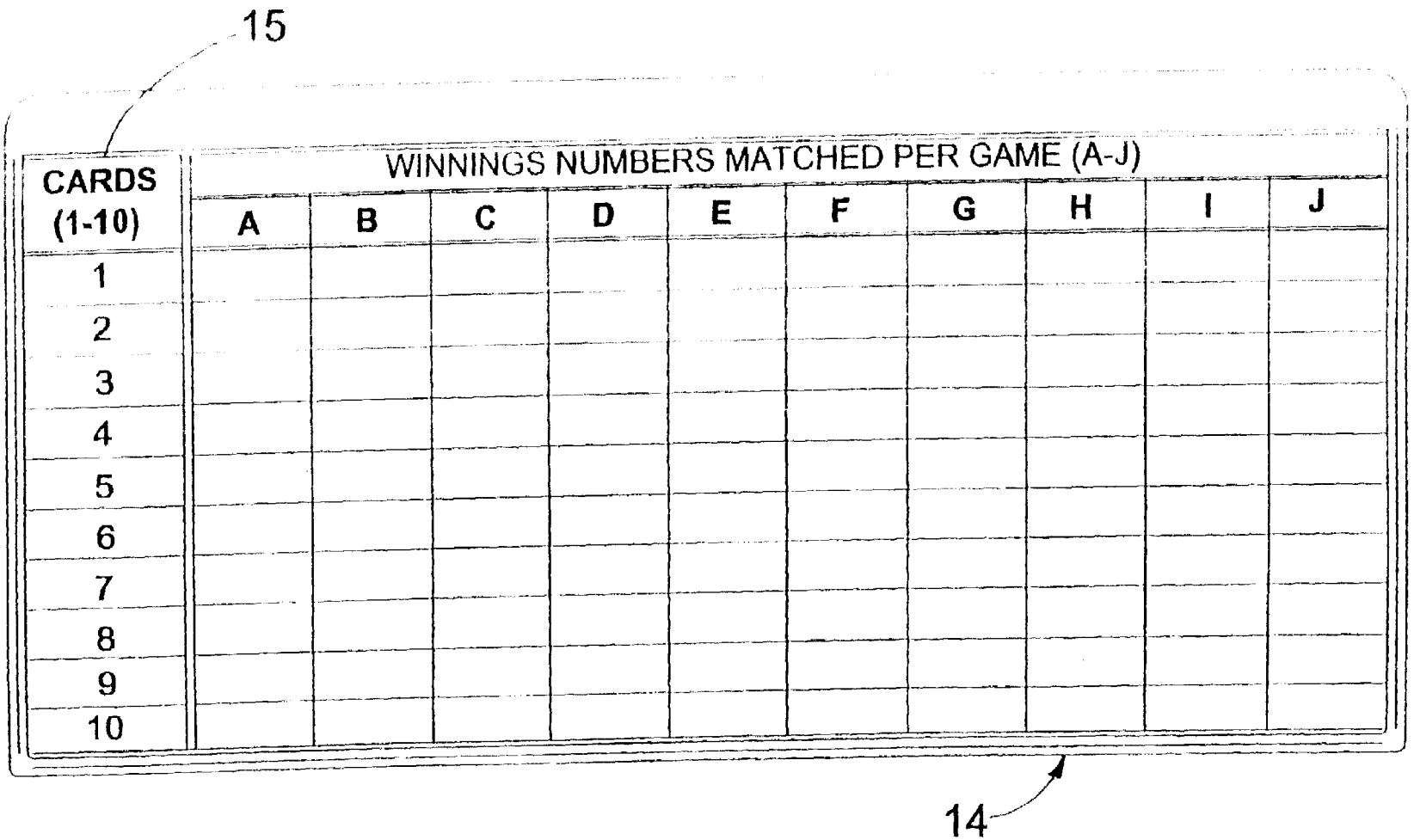
FIG. 3 is a front view of a certain presently preferred embodiment of an envelope for holding lottery cards.
Figure 4:
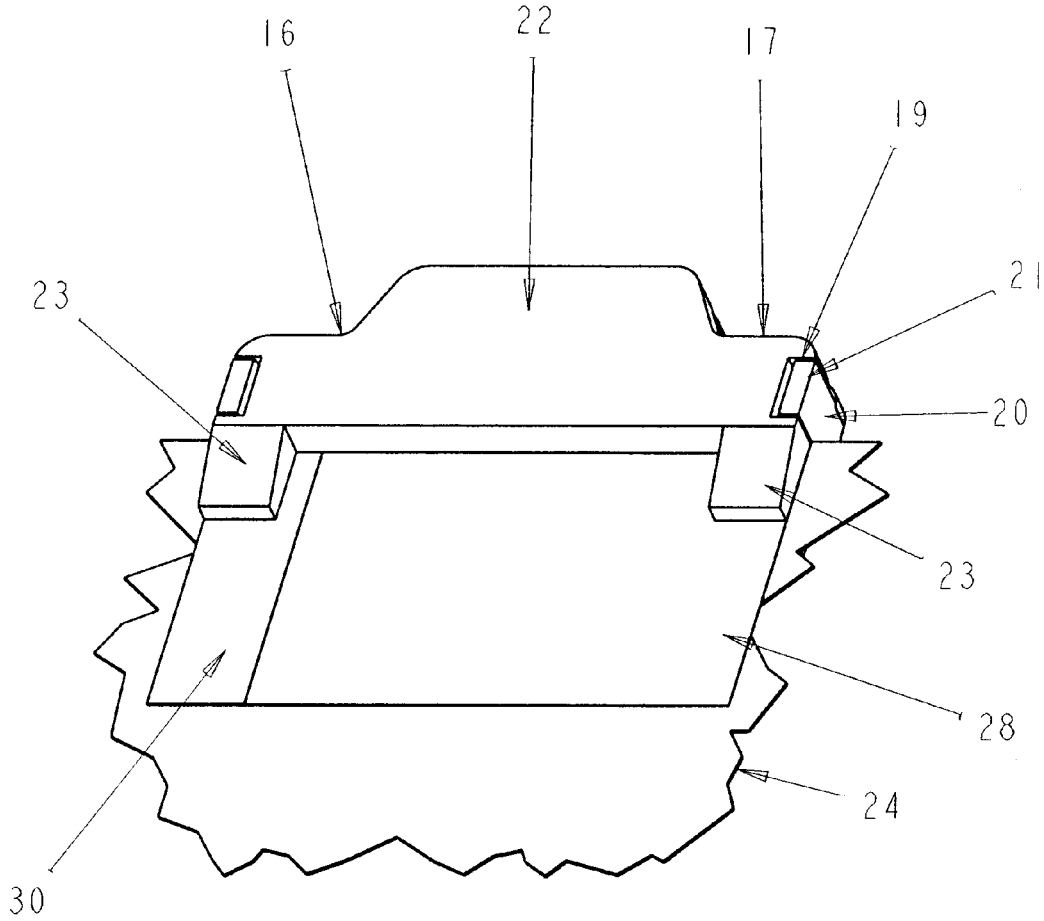
FIG. 4 is an isometric view of an alternative certain presently preferred embodiment of a lottery card reader according to this invention.
Figure 5:
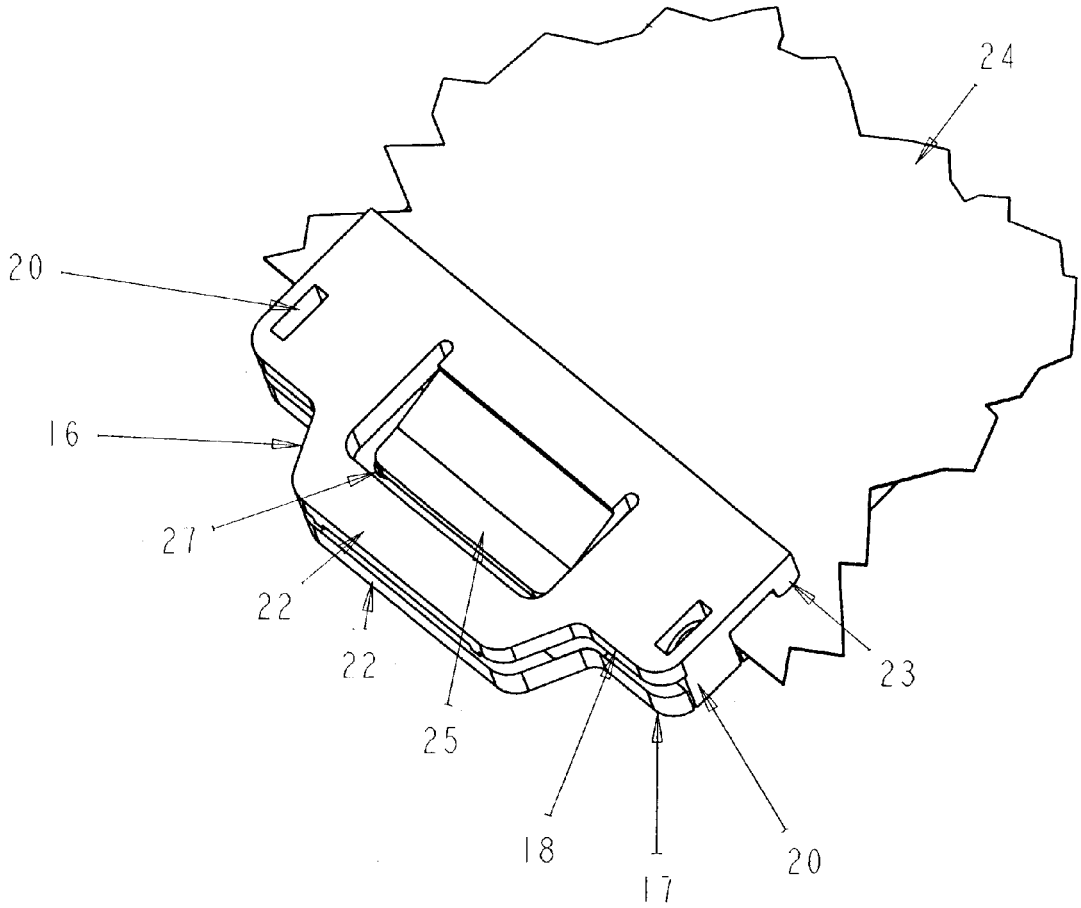
FIG. 5 is an isometric view of the obverse side of the lottery card reader shown in FIG. 4.
Figure 6:
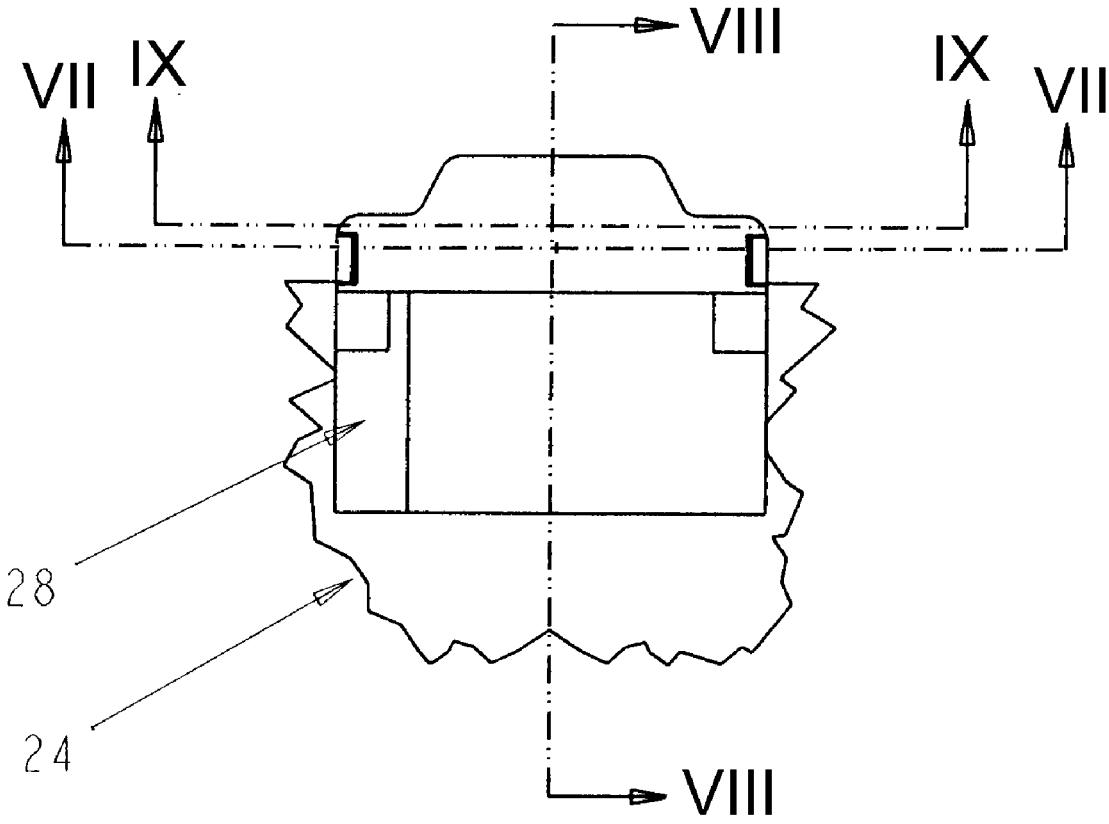
FIG. 6 is a plan view of the lottery card reader of FIG. 4.
Figure 7:
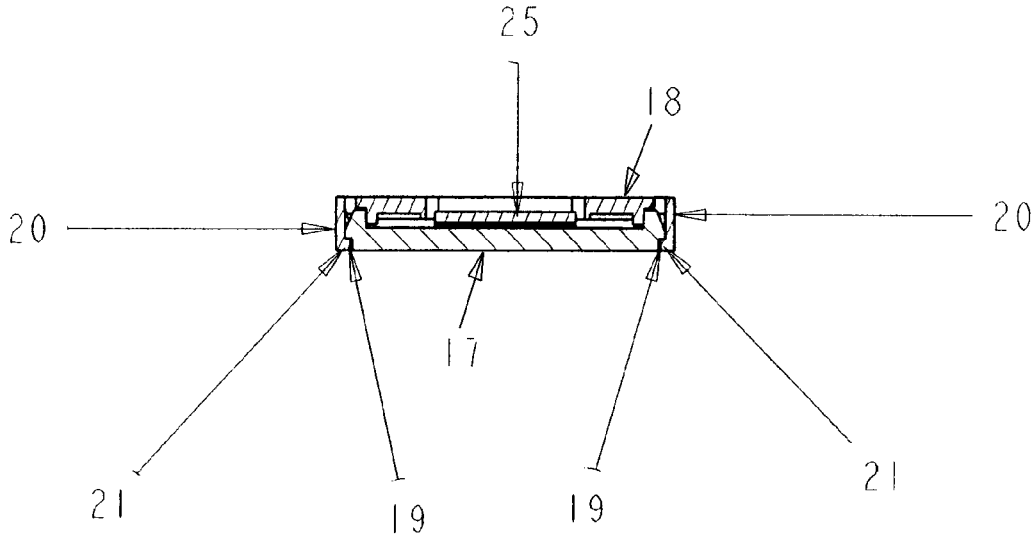
FIG. 7 is sectional view through VII—VII in FIG. 6 (inverted).
Figure 8:
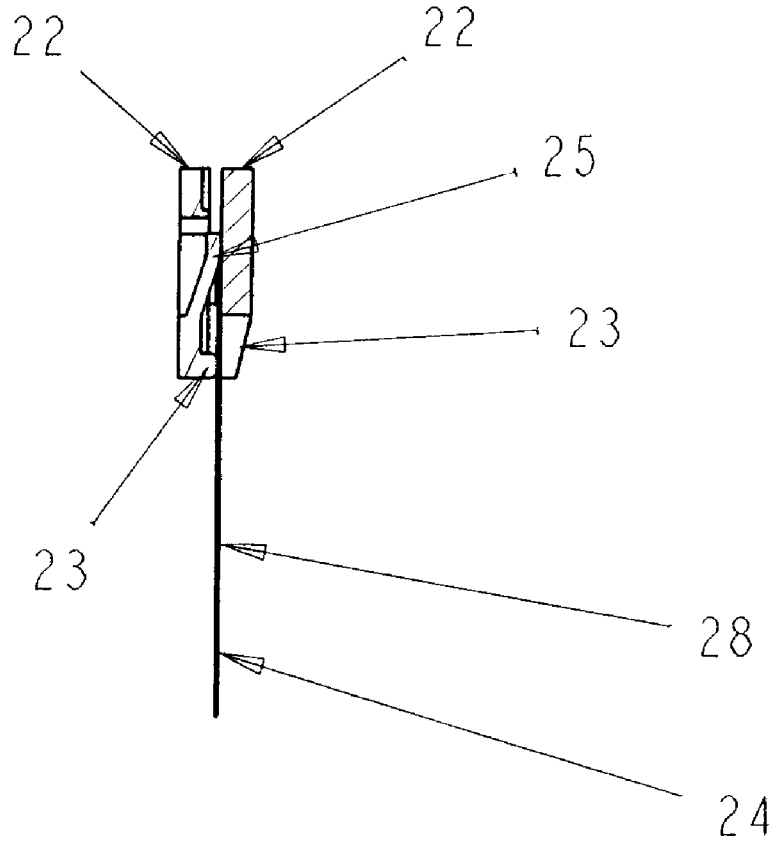
FIG. 8 is a sectional view through VIII—VIII in FIG. 6.
Figure 9:
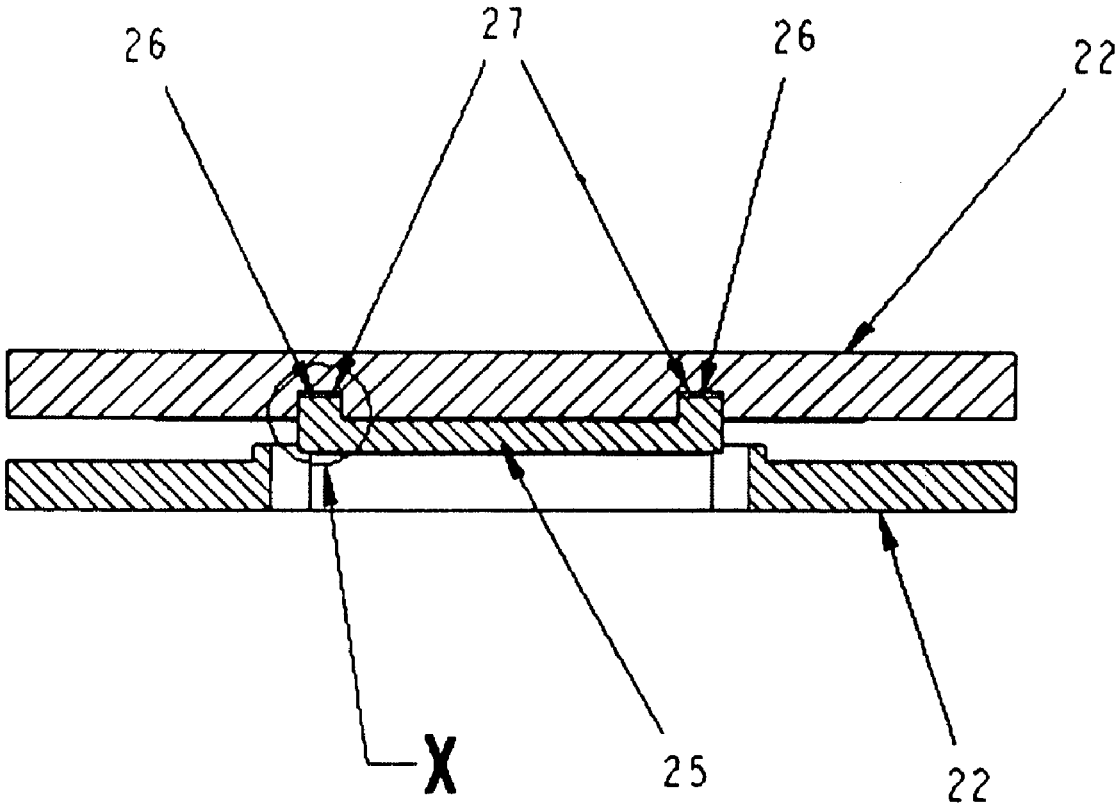
FIG. 9 is a sectional view through IX—IX in FIG. 6.
Figure 10:
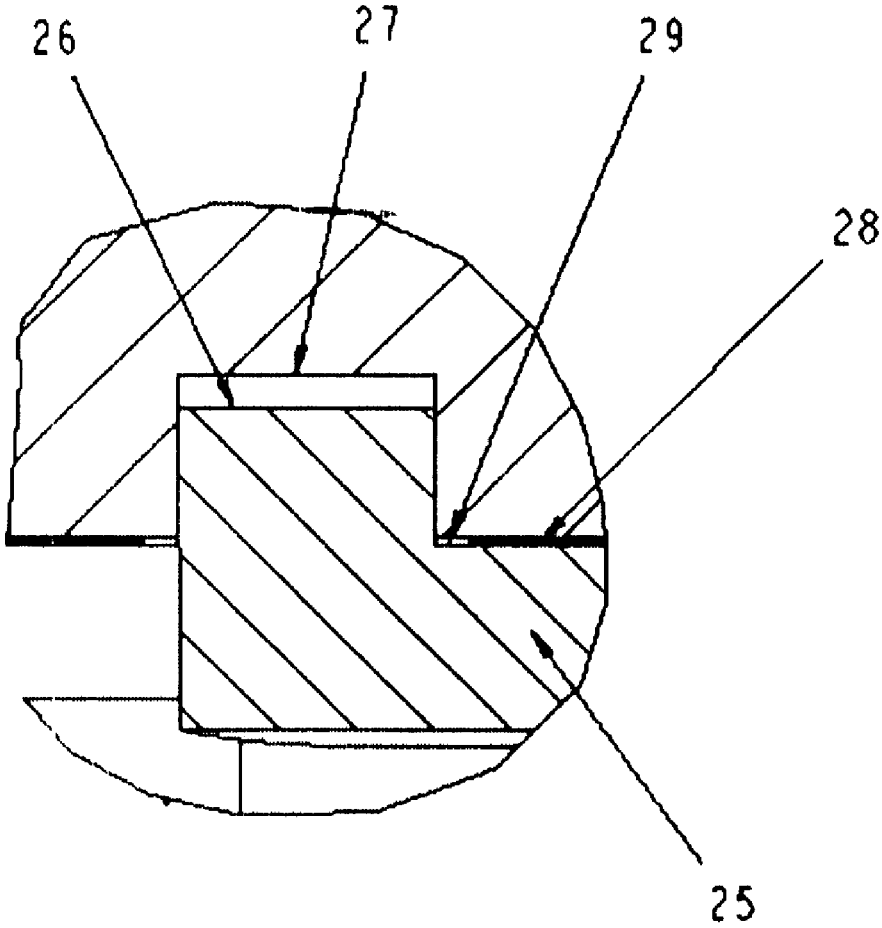
FIG. 10 is an enlargement of the circled area in FIG. 9.

In FIG. 3, an envelope 14 is of a size suitable for holding at least one lottery card. On the face of envelope 14 is printed a table 15. The first column in table 15 has a row numbered for 10 lottery cards and the remaining columns indicated the games playable on each lottery card, in this case labeled A to J. The player can then enter the winning numbers that he selected in the proper row and column and thereby keep track of his winnings. Each of the player's lottery cards can be placed in envelope 14 and lottery card reader 3 can be clipped to envelope 14.

In FIGS. 4, 5, 6, 7, 8, 9, and 10, clip 16 is made from two pieces, an upper portion 17 and a lower potion 18. Clip 16 is preferably made entirely of molded plastic, but could also be made of other materials, such as metal. Upper portion 17 is provided with an indentation 19 on each side and lower portion 18 has two extensions 20 with clasps 21 at the end. Upper portion 17 and lower portion 18 each have arms 22 and 23. When arms 22 are forced together, arms 23 are forced apart, the arms pivoting on extensions 20. The ends of arms 23 make contact when lottery card 24 is not between them and grip lottery card 24 when it is between them. Lower portion 18 is provided with a spring 25 that resiliently biases arms 23 together. At each end of spring 25 is a post 26 (see FIG. 10) that fits into a well 27 in upper portion 17. A flap 28, made of a single, unfolded sheet of transparent material, has a aperture 29 at each end of greater diameter than posts 26. To assemble clip 16, posts 26 are inserted through apertures 29 of flap 28 and upper portion 17 and lower portion 18 are pushed together, forcing clasps 21 apart until they snap into indentations 19. Flap 28 is also provided with a vertical reference mark 30 printed on it, on which numbers can be written. Clip 16 is used in the same manner as clip 4.

The lottery card reader of this invention can be used to read virtually any lottery card, where the lottery card consists of a rectangular sheet on which are marked numbers, letters, or other symbols. Typically, the card is made of stiff or heavy paper, but plastic or other materials could also be used. A typical lottery card is about 8½ to about 9 inches long and about 3 to about 3½ inches wide. Each card typically holds 4 to 10 identical arrays of numbers, with each array being a separate game that must be purchased to play.

The invention claimed is:

1. A lottery card reader comprising (A) a clip having (1) a first molded piece of plastic having a clasping arm, a gripping arm and a fulcrum therebetween;

(2) a second molded piece of plastic having a clasping arm, a gripping arm, a fulcrum therebetween that engages the fulcrum of said first molded piece of plastic, and having a resilient member that extends from said second molded piece of plastic and contacts said first molded piece of plastic;

(3) molded plastic means extending from one of said molded pieces of plastic for attaching said first molded piece of plastic to said second molded piece of plastic so that the clasping arm of said first molded piece of plastic opposes the clasping arm of said second molded piece of plastic and the gripping arm of said first molded piece of plastic opposes the gripping arm of said second molded piece of plastic, and said resilient member resiliently forces said clasping arms towards each other and said gripping arms apart; and (B) a single transparent flap attached to said clip that can cover games on a lottery card to which said clip is attached, whereby a lottery card inserted between said clasping arms under said transparent flap is releaseably gripped by said clasping arms.

2. A lottery card reader according to claim 1 wherein said first molded piece and said second molded piece snap together.

3. A lottery card reader according to claim 2 wherein one of said molded pieces has a pair of arms that snap onto the other of said molded pieces.

4. A lottery card reader according to claim 1 wherein said transparent flap is a single, unfolded sheet.

5. A lottery card reader according to claim 1 wherein said transparent flap can be eraseably written on in ink.

6. A lottery card reader according to claim 1 wherein said transparent flap is about 3 to about 4 inches long and about 1¾ to about 2 inches wide.

7. A lottery card reader according to claim 1 wherein a vertical reference mark is printed on said transparent flap.

8. A lottery card reading assembly comprising (A) a lottery card and (B) a lottery reader according to claim 1 attached thereto.

9. A lottery card reading assembly comprising (A) a lottery card reader according to claim 1 and (B) an envelope in which said lottery card can be placed, where a table is printed on said envelope, said table having spaces therein for inserting information about each of a multiplicity of lottery cards.

10. A lottery card reader according to claim 1 wherein the clasping arm of one of said molded pieces of plastic comprises two parts that extend over only the ends of said transparent flap, leaving the middle of said transparent flap exposed.

11. A lottery card reader comprising (A) a clip consisting essentially of (1) a first molded piece of plastic having a clasping arm, a gripping arm and a fulcrum therebetween;

(2) a second molded piece of plastic having a clasping arm, a gripping arm, a fulcrum therebetween that engages the fulcrum of said first molded piece of plastic, and having a resilient member that extends from said second molded piece of plastic and contacts said first molded piece of plastic;

(3) means for attaching said first molded piece of plastic to said second molded piece of plastic so that the clasping arm of said first molded piece of plastic opposes the clasping arm of said second molded piece of plastic and the gripping arm of said first molded piece of plastic opposes the gripping arm of said second molded piece of plastic, and said resilient member resiliently forces said clasping arms towards each other and said gripping arms apart, said means comprising a pair of arms that extend from one of said molded pieces of plastic that snap into indentations on the other of said molded pieces of plastic; and (B) a transparent flap that is a single, unfolded sheet attached to said clip that can cover games on a lottery card to which said clip is attached, whereby a lottery card inserted between said clasping arms under said transparent flap is releaseably gripped by said clasping arms.

12. A lottery card reader according to claim 11 wherein the clasping arm of one of said molded pieces of plastic comprises two parts that extend over only the ends of said transparent flap, leaving the middle of said transparent flap exposed.

13. A lottery card reader according to claim 11 wherein said transparent flap can be eraseably written on in ink.

14. A lottery card reader according to claim 11 wherein said transparent flap is about 3 to about 4 inches long and about 1¾ to about 2 inches wide.

15. A lottery card reader according to claim 11 wherein a vertical reference mark is printed on said transparent flap.

16. A lottery card reading assembly comprising (A) an envelope upon which is printed a table having spaces therein for inserting information about each of a multiplicity of lottery cards and (B) a lottery card reader according to claim 11 clipped thereto.

17. A lottery card reading assembly comprising (A) a lottery card and (B) a lottery reader according to claim 11 attached thereto.

18. A lottery card reader comprising (A) a clip consisting essentially of (1) a first molded piece of plastic having a clasping arm, a gripping arm and a fulcrum therebetween;

(2) a second molded piece of plastic having a clasping arm, a gripping arm, a fulcrum therebetween that engages the fulcrum of said first molded piece of plastic, and having a resilient member that extends from said second molded piece of plastic and contacts said first molded piece of plastic;

(3) means for attaching said first molded piece of plastic to said second molded piece of plastic so that the clasping arm of said first molded piece of plastic opposes the clasping arm of said second molded piece of plastic and the gripping arm of said first molded piece of plastic opposes the gripping arm of said second molded piece of plastic, and said resilient member resiliently forces said clasping arms towards each other and said gripping arms apart, said means comprising a pair of arms that extend from one of said molded pieces of plastic at said pivot point, that snap into indentations on the other of said molded pieces of plastic; and (B) a rectangular transparent flap that is a single, unfolded sheet about 3 to about 4 inches long by about 1¾ to about 2 inches wide having a vertical reference line printed thereon, attached to said clip which can cover games on a lottery card to which said clip is attached, wherein the clasping arm of one of said molded pieces of plastic comprises two parts that extend over only the ends of said transparent flap, leaving the middle of said transparent flap exposed, whereby a lottery card inserted between said second pair of arms under said transparent flap is releaseably gripped by said second pair of arms.

19. A lottery card reader according to claim 18 wherein said transparent flap can be eraseably written on in ink.

20. A lottery card reading assembly comprising (A) a lottery card and (B) a lottery reader according to claim 18 attached thereto.

* * * * *